US010139852B2

(12) United States Patent
Crosby et al.

(10) Patent No.: US 10,139,852 B2
(45) Date of Patent: Nov. 27, 2018

(54) ASSISTIVE CONTROL ATTACHMENT FOR AN APPLIANCE

(71) Applicant: Haier US Appliance Solutions, Inc., Wilmington, DE (US)

(72) Inventors: Jonathan Charles Crosby, Louisville, KY (US); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/498,604

(22) Filed: Apr. 27, 2017

(65) Prior Publication Data

US 2018/0314287 A1 Nov. 1, 2018

(51) Int. Cl.

| | |
|---|---|
| ***G05G 1/54*** | (2008.04) |
| ***G05G 25/00*** | (2006.01) |
| ***G05G 1/08*** | (2006.01) |
| ***G08B 21/18*** | (2006.01) |
| ***F24C 3/12*** | (2006.01) |
| ***F24C 7/08*** | (2006.01) |

(52) U.S. Cl.

CPC ..... *G05G 1/54* (2013.01); *F24C 3/124* (2013.01); *F24C 7/082* (2013.01); *G05G 1/08* (2013.01); *G05G 25/00* (2013.01); *G08B 21/18* (2013.01)

(58) Field of Classification Search

CPC . G05G 1/54; G05G 1/08; G05G 25/00; F24C 7/082; F24C 3/124; G08B 21/18

See application file for complete search history.

(56) References Cited

U.S. PATENT DOCUMENTS

| | | | | |
|---|---|---|---|---|
| 4,165,659 | A * | 8/1979 | Fawley | F16K 27/12 150/154 |
| 7,327,348 | B2 | 2/2008 | Goldenberg et al. | |
| 9,406,456 | B2 | 8/2016 | O'Keeffe | |
| 2012/0316884 | A1* | 12/2012 | Rozaieski | A61G 5/10 704/275 |
| 2012/0325197 | A1* | 12/2012 | Legaspi | F23N 5/242 126/42 |
| 2013/0260320 | A1 | 10/2013 | Townsend | |
| 2016/0049052 | A1* | 2/2016 | Cheatham, III | G08B 7/00 348/14.16 |
| 2016/0051078 | A1* | 2/2016 | Jenkins | A47J 27/62 99/331 |
| 2016/0063837 | A1* | 3/2016 | Shao | G08B 21/0484 340/540 |
| 2016/0333990 | A1* | 11/2016 | Edinger | F24C 7/08 |
| 2017/0185099 | A1* | 6/2017 | Edinger | F24C 7/08 |

FOREIGN PATENT DOCUMENTS

| | | |
|---|---|---|
| GB | 2299160 B | 9/1996 |

* cited by examiner

*Primary Examiner* — Brian Wilson
(74) *Attorney, Agent, or Firm* — Dority & Manning, P.A.

(57) ABSTRACT

An assistive control attachment for an appliance can include features for sensing the position or orientation of the assistive control attachment, determining the mode of operation of the appliance based at least in part on the position of the assistive control attachment, communicating the mode of operation of the appliance to a user, or a combination thereof.

19 Claims, 10 Drawing Sheets

ASSISTIVE CONTROL ATTACHMENT FOR AN APPLIANCE

FIELD OF THE INVENTION

The present subject matter relates generally to consumer appliances and more particularly to an assistive control attachment for consumer appliances.

BACKGROUND OF THE INVENTION

Individuals with certain impairments (visual impairment, musculoskeletal impairment, neurological disorders, etc.) may have difficulty operating appliances with conventional appliance controls, such as e.g., knobs, rotary dials, switches, etc. Often the position and/or orientation of a conventional appliance control dictates the mode of operation or setting of the appliance. For example, cooktop appliances traditionally include control knobs that can be rotated to adjust the power setting (e.g., "high", "medium", "low", "off", etc.) of one of the heating elements of the cooktop appliance. If an individual is unable to discern the selected power setting, the individual's experience with the cooktop appliance may be greatly diminished and proper usage may be difficult.

Conventionally, few assistive options have been available for individuals with impairments in operating their appliances. In some instances, for example, individuals have resorted to memorizing the modes of operation of their appliances in order to select the desired control setting. In other instances, individuals have turned to expensive alternatives, such as purchasing custom appliances with modified appliance controls or employing a caretaker to operate their appliances. Memorizing how the position of the appliance control corresponds to the modes of operation of the appliance can be an inconvenience. Moreover, custom appliances are generally expensive, not readily available in the marketplace, and not customized to the particular needs of an individual. In addition, employing a caretaker can be expensive and can result in a loss of independence for the individual.

Accordingly, an assistive control attachment for a consumer appliance would be useful. More particularly, an assistive control attachment that includes features for communicating the mode of operation of an appliance to a user would be particularly beneficial.

BRIEF DESCRIPTION OF THE INVENTION

The present disclosure provides an assistive control attachment for an appliance. The assistive control attachment can include features for sensing the position or orientation of the assistive control attachment, determining the mode of operation of the appliance based at least in part on the position of the assistive control attachment, communicating the mode of operation of the appliance to a user, and/or a combination thereof. Additional aspects and advantages of the invention will be set forth in part in the following description, or may be apparent from the description, or may be learned through practice of the invention.

In one exemplary aspect, an assistive control attachment for an appliance for communicating a mode of operation of the appliance to a user is provided. The assistive control attachment includes a control attachment housing configured to be attached to the appliance. The assistive control attachment also includes a sensing device connected to the control attachment housing. The assistive control attachment further includes a communication interface connected to the control attachment housing, the communication interface configured to communicate the mode of operation of the appliance to the user. Moreover, the assistive control attachment includes a controller connected to the control attachment housing and communicatively coupled with the sensing device and the communication interface, the controller configured to: receive one or more signals from the sensing device indicative of the position of the assistive control attachment; determine a position of the assistive control attachment based at least in part on the one or more signals; determine the mode of operation of the appliance based at least in part on the position of the assistive control attachment; and send one or more signals to the communication interface to communicate the mode of operation of the appliance to the user.

In some embodiments, the assistive control attachment is selectively moveable between two or more modes of operation of the appliance.

In some embodiments, the assistive control attachment is coupled with an existing appliance control selectively moveable between two or more modes of operation of the appliance.

In some embodiments, the assistive control attachment is calibrated such that the position of the assistive control attachment corresponds with one of the modes of operation or settings of the appliance.

In some embodiments, to determine the mode of operation of the appliance based at least in part on the position of the assistive control attachment, the controller is configured to: correlate the position of the assistive control attachment with one of the modes of operation of the appliance.

In some embodiments, the sensing device is a three-axis accelerometer.

In some embodiments, the sensing device is a magnetometer.

In some embodiments, the sensing device is a gyroscope.

In some embodiments, the communication interface comprises a network interface for communicating the mode of operation of the appliance to a user over a network.

In some embodiments, when the user manipulates the assistive control attachment to one of the modes of operation of the appliance, the sensing device sends the one or more signals to the controller.

In some embodiments, when the user makes a status request as to a current mode of operation of the appliance, the sensing device sends the one or more signals to the controller.

In some embodiments, the communication interface comprises a vibration device for vibrating the control attachment housing to communicate the mode of operation of the appliance to the user.

In some embodiments, the communication interface comprises a speaker and a microphone for audibly communicating the mode of operation of the appliance to the user via voice control.

In some embodiments, the communication interface comprises one or more lighting devices for communicating the mode of operation of the appliance to the user.

In some embodiments, the communication interface comprises a network interface, and wherein the network interface is communicatively coupled with a home control system, and wherein the assistive control attachment can communicate the mode of operation of the appliance to the user via the home control system.

In another exemplary aspect, a method for communicating a mode of operation of an appliance to a user using an assistive control attachment is provided. The assistive control attachment is connected to the appliance and includes a sensing device, a controller, and a communication interface. The method includes determining a position of the assistive control attachment based at least in part on one or more signals received from the sensing device; determining, using the controller, a mode of operation of the appliance based at least in part on the position of the assistive control attachment; and communicating, using the communication interface, the mode of operation of the appliance to the user.

In some implementations, during determining the mode of operation of the appliance based at least in part on the position of the assistive control attachment, the method further includes: correlating the determined position to one of the modes of operation of the appliance.

In some implementations, prior to determining the position of the assistive control attachment, the method further includes: manipulating the assistive control attachment.

In some implementations, prior to determining the position of the assistive control attachment, the method further includes: receiving a status request as to a current mode of operation of the appliance from the user.

In some implementations, the assistive control attachment communicates the mode of operation to the user via audible output.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
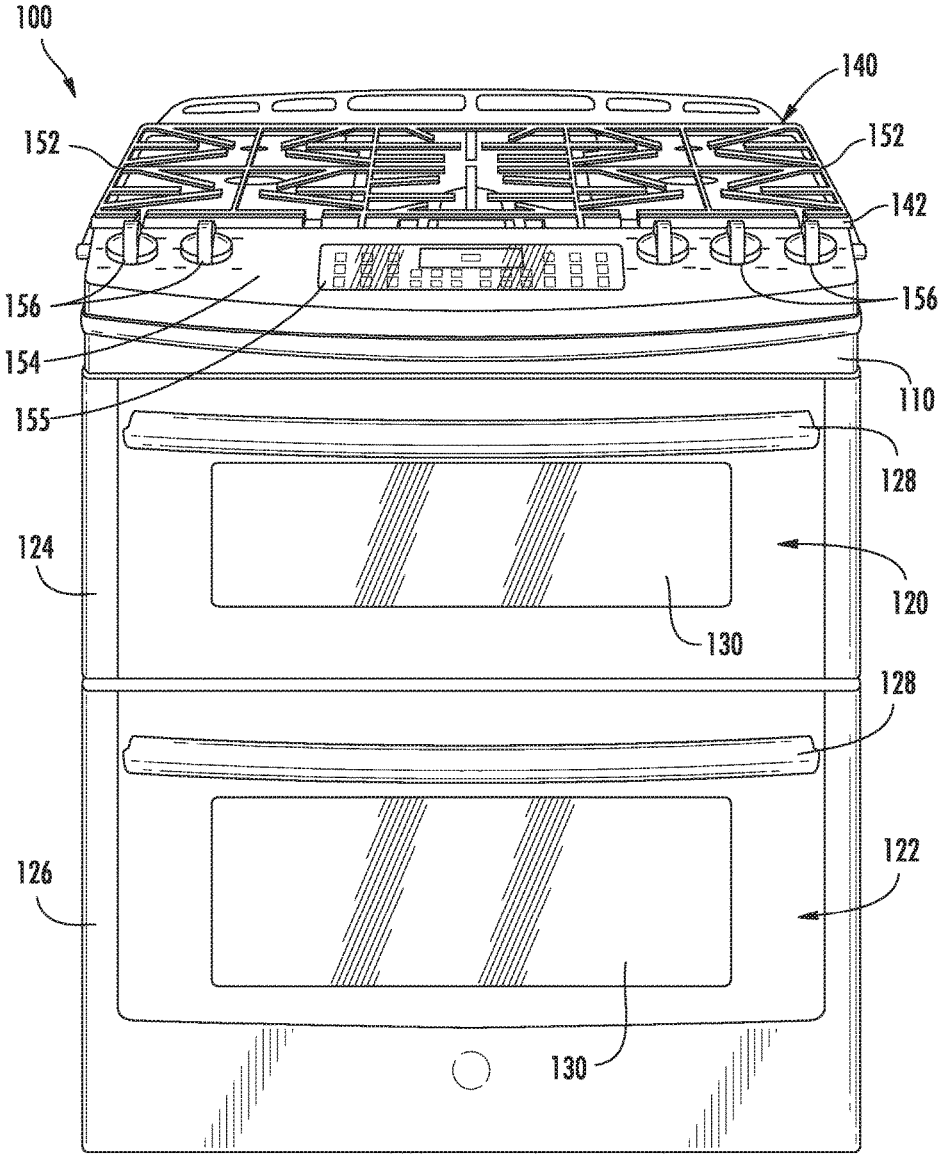
FIG. 1 provides a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
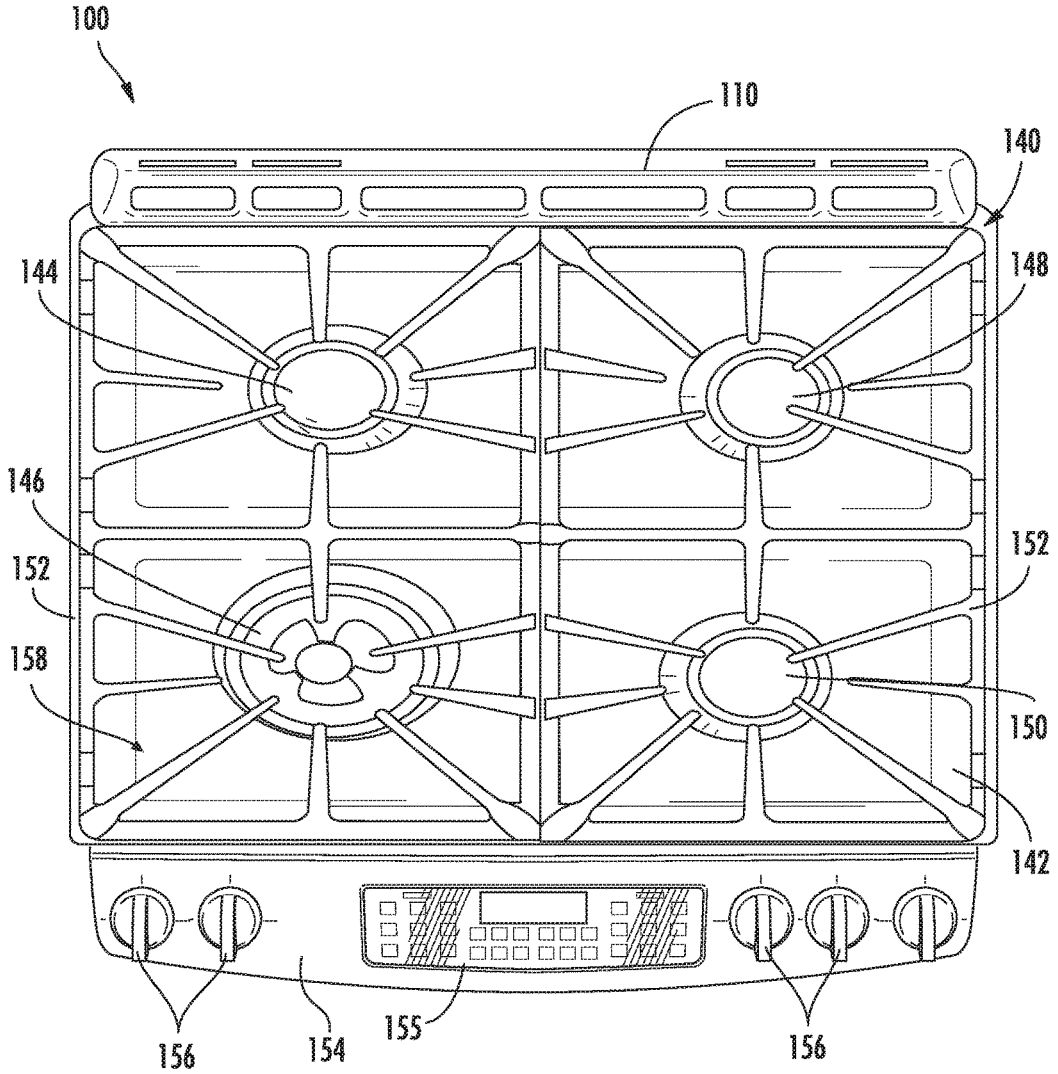
FIG. 2 provides a top view of the exemplary range appliance of FIG. 1.

FIG. 1 provides a front, perspective view of a range appliance 100 according to an exemplary embodiment of the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only. It will be appreciated that the present subject matter may be used in or employed with any suitable appliance (e.g. a washing machine appliance, a dryer appliance, a microwave appliance, a refrigerator appliance, an oven appliance, etc.) having one or more appliance controls (e.g., knobs, rotary dials, switches, etc.). Thus, the exemplary embodiment shown in FIG. 1 is not intended to limit the present subject matter to any particular appliance.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and/or combinations thereof.

For range appliance 100, a utensil holding food and/or cooking liquids (e.g., oil, water, etc.) may be placed onto grates 152 at a location of any of burner assemblies 144, 146, 148, 150 (FIG. 2). Burner assemblies 144, 146, 148, 150 provide thermal energy to cooking utensils positioned on grates 152. As shown in FIG. 1, burner assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A control panel 154 is located within convenient reach of a user of range appliance 100. Control panel 154 includes a user interface panel 155 that provides one or more user input selectors (not labeled) for user manipulation of range appliance 100 and one or more graphical display devices (not labeled) that deliver certain information to the user, such as e.g., whether a particular burner assembly is activated and/or the rate at which the burner assembly is set.

Control panel 154 also includes a number of assistive control attachments 156. For this exemplary embodiment, assistive control attachments 156 are shown as knobs and are each associated with one of burner assemblies 144, 146, 148, 150 and griddle burner 160 for controlling range appliance 100. In a similar fashion to an unmodified knob, a user can manipulate one of the assistive control attachments 156 to activate its corresponding burner assembly and to determine the amount of heat input provided to a cooking utensil located thereon. As detailed herein, each assistive control attachment 156 includes features for communicating a mode of operation of range appliance 100 to a user, particularly those with certain impairments. In this way, users with impairments can utilize range appliance 100 with the confidence that they have selected the correct heat setting or mode of operation of range appliance 100 and can do so without the assistance of others.

By way of example, suppose a user with a visual impairment wishes to turn the left front burner assembly 146 of range appliance 100 to a medium heat setting. Further, suppose that the user with the visual impairment is unable to discern or clearly see the graphical display device of user interface panel 155 or labels adjacent assistive control attachment 156 that display the heat setting for burner assembly 146. When the user manipulates assistive control attachment 156 (i.e., by rotating assistive control attachment 156), assistive control attachment 156 can communicate the selected heat setting to the user via a communication interface, such as a speaker device. For instance, upon user manipulation of assistive control attachment 156, the speaker device can communicate to the user "left front burner set to medium." In this manner, assistive control attachment 156 has confirmed that the user has selected the correct setting, and accordingly, the user no longer has to guess or hope that the correct heat setting was chosen.

Although assistive control attachments 156 are shown as knobs in FIGS. 1 and 2, it will be appreciated that assistive control attachments 156 are provided by way of example only. More specifically, assistive control attachments 156 can be any suitable type of appliance control or can attach or be mounted to any suitable type of appliance control, such as e.g., knobs, rotary dials including both mechanical and electro-mechanical dials, switches, push buttons, etc., that are selectively moveable between two or more modes of operation of the appliance. For example, the modes of operation can be "on" and "off"; "high", "medium", or "low" for a cooktop; "normal", "heavy", "light", "delicates", etc. for a washing machine appliance; or "cottons", "delicates", "bulky", "perm press", etc. for a dryer appliance.

In some embodiments, assistive control attachment 156 can be a modified version of an existing control knob (or more broadly an existing appliance control). Stated alternatively, an existing appliance control can be modified such that it is configured with assistive functionality (i.e., by adding the components of assistive control attachment 156 to be described herein). In this way, a user can receive the benefit of assistive functionality without need to purchase a new appliance or a new appliance control. In yet other exemplary embodiments, assistive control attachment 156 can be shaped in the form of an existing appliance control (e.g., a knob) and can replace the existing appliance control. In this manner, a user can remove the existing appliance control and can replace it with assistive control attachment 156 without need to assemble assistive appliance control 156.

Figure 3:
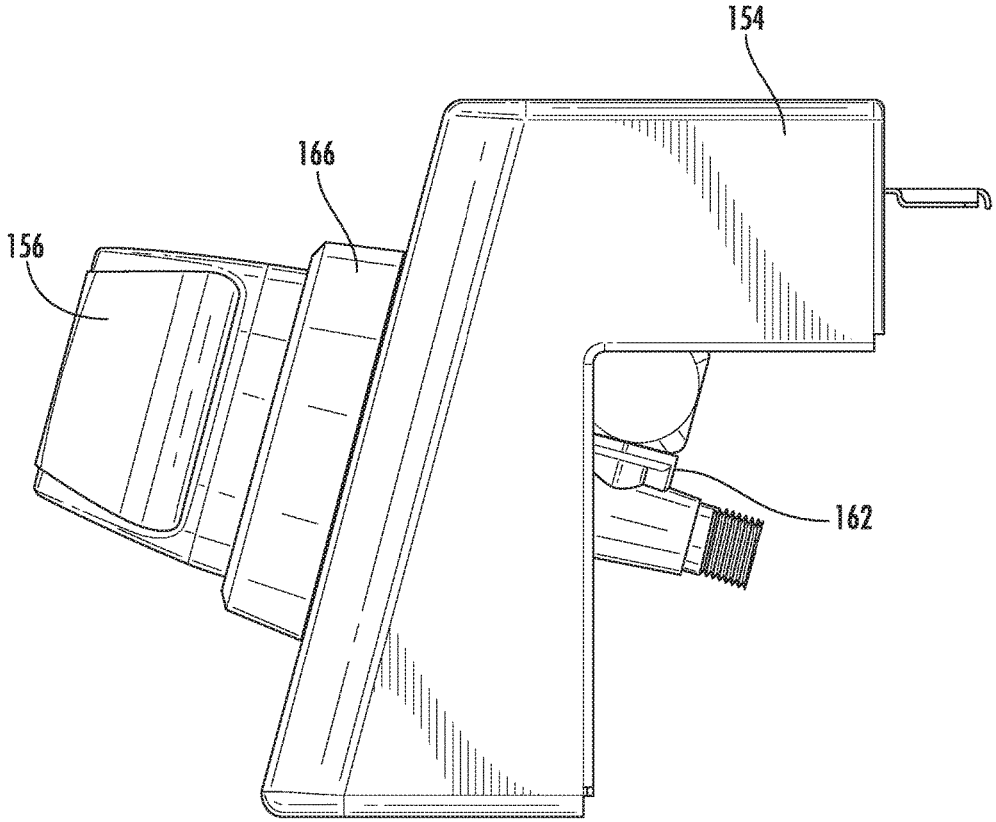
FIG. 3 provides a side, elevation view of a control panel of the exemplary range appliance of FIG. 1.
Figure 4:
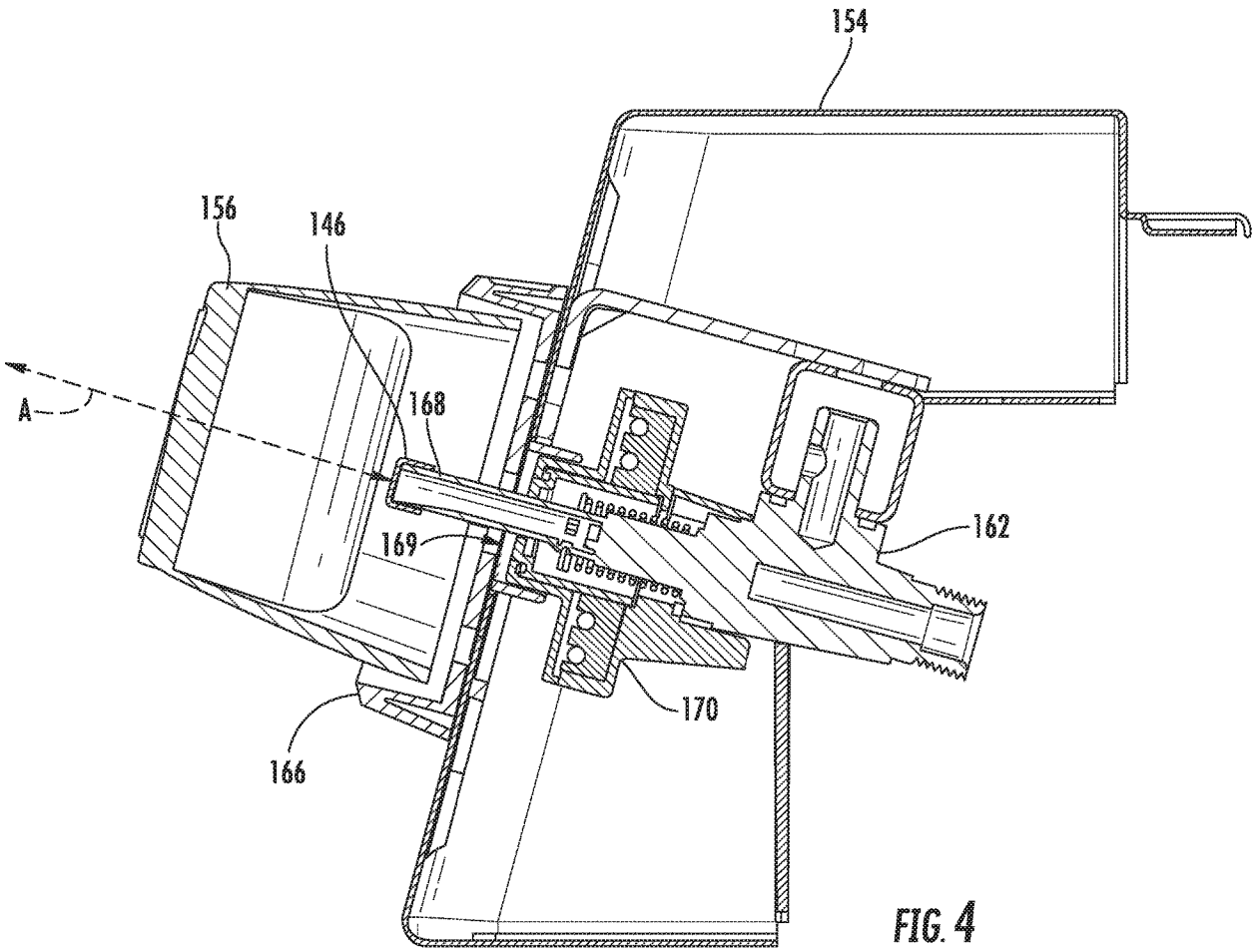
FIG. 4 provides a side, section view of the exemplary control panel of FIG. 3.

As an example, FIG. 3 provides a side, elevation view of exemplary assistive control attachment 156 of FIGS. 1 and 2 attached or mounted to control panel 154 of range appliance 100 according to an exemplary embodiment of the present subject matter and FIG. 4 provides a cross sectional view thereof. For this embodiment, assistive control attachment 156 is shaped in the form of an existing appliance control (i.e., a control knob of range appliance 100). Assistive control attachment 156 can be attached or mounted to control panel 154 in any suitable manner.

For instance, a control valve 162 positioned within an interior of control panel 154 can include a stem 168 extending through an opening 169 defined in control panel 154 and can extend outward from control panel 154 along an axial direction A. Control valve 162 is configured for regulating a flow of gaseous fuel (e.g., propane or natural gas) from a fuel line to one of the burner assemblies 144, 146, 148, 150, 160. An end of stem 168 of control valve 162 can be inserted into a receiving portion 164 of assistive control attachment 156 to operatively couple assistive control attachment 156 with control valve 162. Additionally, as shown, a bezel 166 is positioned on the outer surface of control panel 154 and is disposed between control panel 154 and assistive control attachment 156. Bezel 166 may cover or hide a gap between assistive control attachment 156 and panel 154 in order to improve a cosmetic appearance of range appliance 100.

A user may rotate assistive control attachment 156 that in turn rotates stem 168 in order to adjust control valve 162 between an open and a closed configuration to selectively allow gaseous fuel to flow to burner assemblies 144, 146, 148, 150, 160. In this way, control valve 162 is selectively adjustable between the open configuration and the closed configuration. In the closed configuration, control valve 162 blocks gaseous fuel flow to its corresponding burner assembly 144, 146, 148, 150, 160. Conversely, control valve 162 permits gaseous fuel flow to its corresponding burner assembly 144, 146, 148, 150, 160 in the open configuration. Control valve 162 also includes a spark switch 170 operatively coupled thereto. Spark switch 170 is configured for electrically connecting a power supply to an igniter (not shown) at one of burner assemblies 144, 146, 148, 150. In particular, spark switch 170 may be configured for closing an electrical circuit to the igniter when a user manipulates (i.e., rotates) assistive control attachment 156 such that stem 168 adjusts control valve 162 to the open configuration, and spark switch 170 may be configured for opening the electrical circuit to the igniter when the user manipulates assistive control attachment 156 such that stem 168 adjusts control valve 162 to the closed configuration. In this way, spark switch 170 may assist with igniting gaseous fuel at burners of range appliance 100, as will be appreciated.

As shown in FIGS. 3 and 4, assistive control attachment 156 can be mounted and attached to control panel 154 in the same or similar manner as an existing appliance control and is selectively moveable between two or more modes of operation of range appliance 100. That is, assistive control attachment 156 can be rotated to an "on" position, an "off position", or to any other suitable heat setting of range appliance 100.

Figure 5:
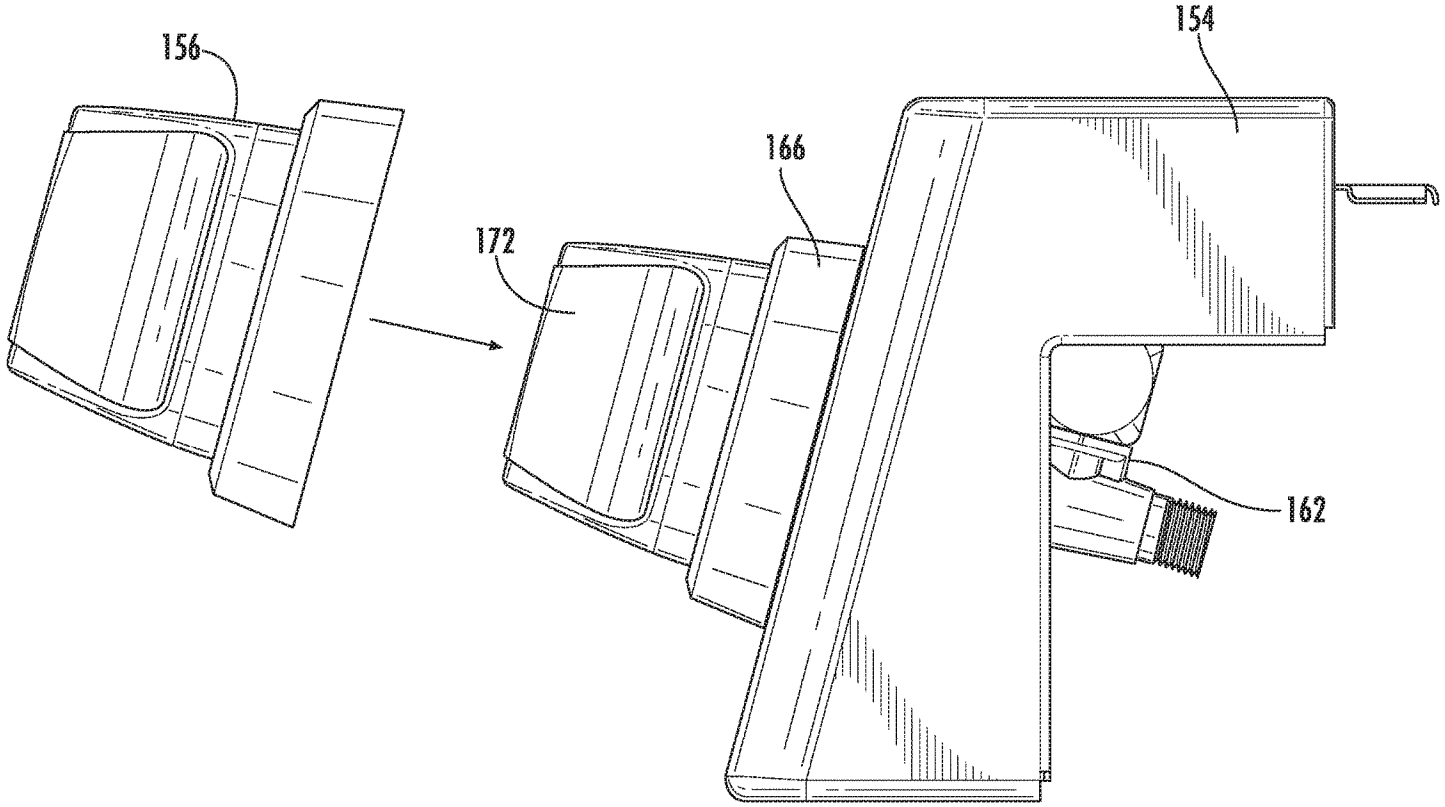
FIG. 5 provides a side, elevation view of an exemplary control panel according to an exemplary embodiment of the present subject matter.

In some embodiments, assistive control attachment 156 can be attached to or mounted to an existing appliance control. For example, assistive control attachment 156 can be shaped to fit over or overlay an existing appliance control as shown in FIG. 5. FIG. 5 provides a side, elevation view of exemplary assistive control attachment 156 attached or mounted to an existing control knob 172 according to an exemplary embodiment of the present subject matter. As shown, assistive control attachment 156 can be mounted, attached, or otherwise connected to an existing appliance control. More particularly, for this embodiment, assistive control attachment 156 is shaped complementary to existing control knob 172 such that it may overlay or fit over existing control knob 172. In this way, a user need not remove existing control knob 172. Rather, a user may fit assistive control attachment 156 over existing control knob 172 without removing or altering the existing controls of range appliance 100. It will be appreciated that assistive control attachment 156 need not be shaped complementary to existing control knob 172. For example, in some embodiments, assistive control attachment 156 can be a generally rectangular shape that can attach to any surface of existing control knob 172. Other configurations are also possible.

Figure 6:
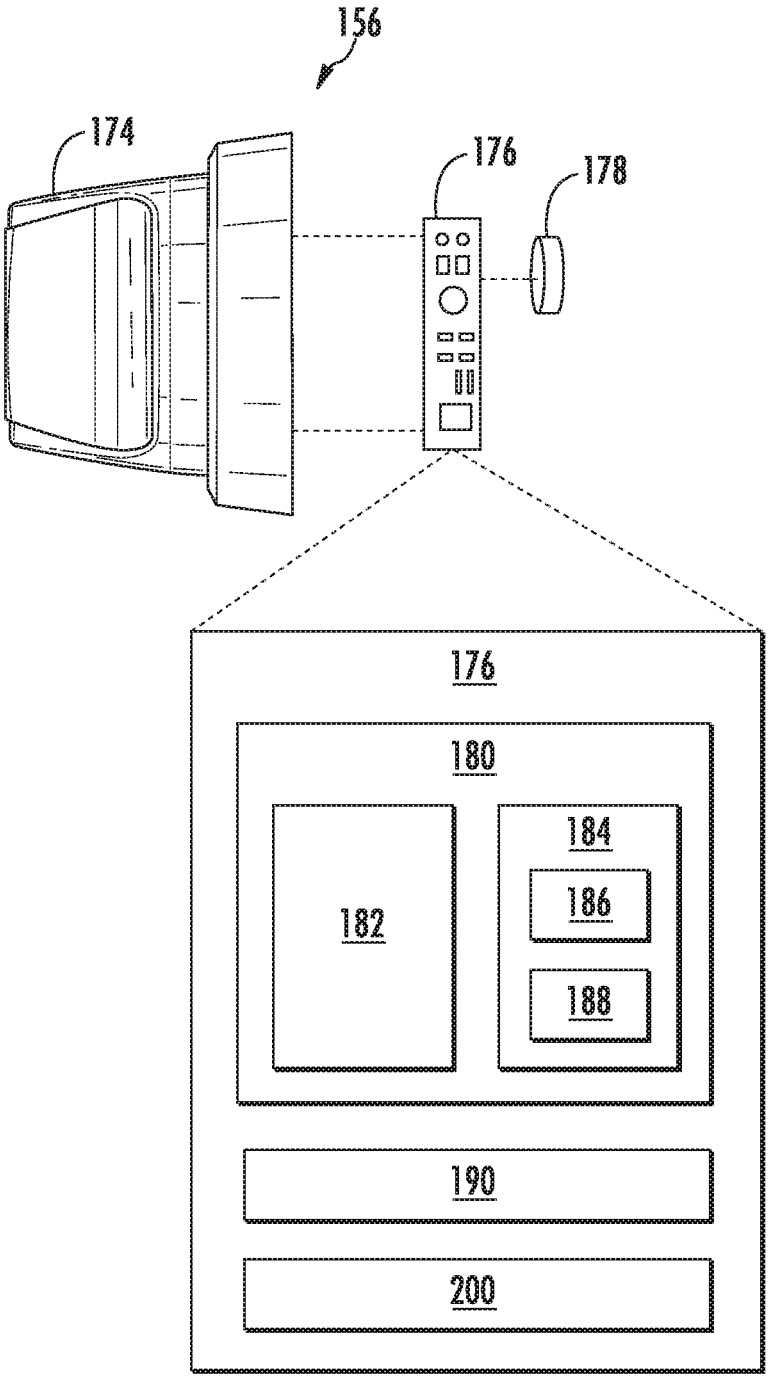
FIG. 6 provides an exploded view of an exemplary assistive control attachment according to an exemplary embodiment of the present subject matter.
Figure 7:
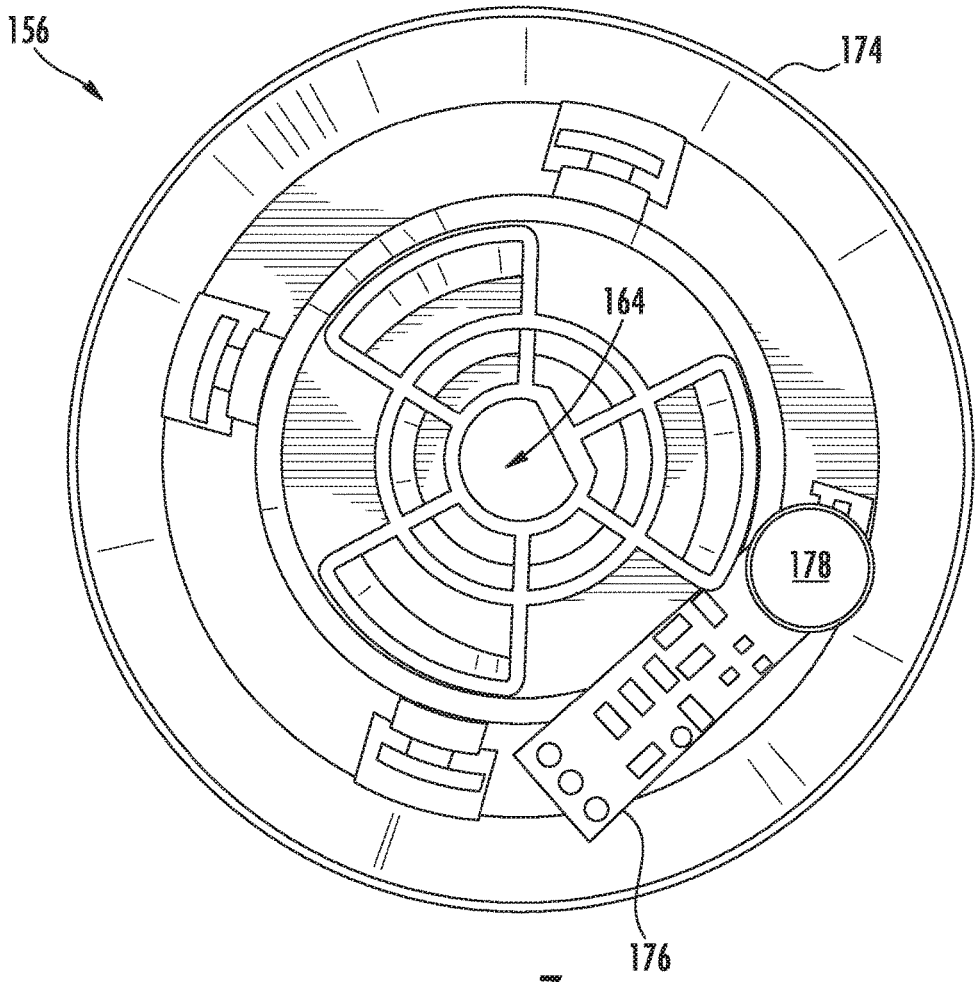
FIG. 7 provides a bottom view of the exemplary assistive control attachment of FIG. 6.

FIG. 6 provides an exploded view of exemplary assistive control assembly 156 according to exemplary embodiments of the present disclosure. FIG. 7 provides a bottom view of the assistive control attachment 156 of FIG. 6 in an assembled configuration. As shown in FIG. 6, assistive control attachment 156 includes a control attachment housing 174, a circuit board 176, and a power source 178. Housing 174, circuit board 176, and power source 178 are shown in an exploded view arrangement in FIG. 6 but it will be appreciated that circuit board 176 and power source 178 can be connected to (e.g., attached, embedded, mounted, etc.) housing 174 as shown in FIG. 7. Circuit board 176 and power source 178 can be connected with housing 174 in any suitable fashion. For example, circuit board 176 and power source 178 can be attached to housing 174 as shown in FIG. 7, they can be embedded within one of the walls of housing 174, and/or can be attached or mounted to an external surface of one of the walls of housing 174. Circuit board 176 and power source 178 can be directly connected to housing 174 or indirectly connected thereto (i.e., by being connected to another component that is connected to housing 174).

Power source 178 is in electrical communication with circuit board 176 to provide power thereto and to the various components mounted thereon. Power source 178 can be any suitable power source for powering circuit board 176. For this embodiment, power source 178 is a coin-shaped rechargeable battery. In some embodiments, power source 178 can be a line voltage. In some embodiments, power source 178 can be a power supply in electrical communication with a line voltage supplying power to range appliance 100. The power supply can be in electrical communication with circuit board 176 via one or more wired connections, for example.

As further shown in FIG. 6, circuit board 176 includes a controller 180 attached to or integral with circuit board 176. In some embodiments, controller 180 need not be attached to or integral with circuit board 176. Controller 180 can be directly connected to housing 174 or can be indirectly connected to housing 174 (e.g., by being attached to circuit board 176 which is in turn connected to housing 174).

For this embodiment, controller 180 includes one or more processors 182 and one or more memory devices 184. Processors 182 can be any suitable type of processing device (e.g., any combination of general or special purpose processors, CPUs, a processor core, a microprocessor, an ASIC, a FPGA, a microcontroller, etc.) and can be one processor or a plurality of processors that are operatively connected. Additionally or alternatively, controller 180 may be constructed without using a processor, e.g., using a combination of discrete analog and/or digital logic circuitry (such as switches, amplifiers, integrators, comparators, flip-flops, AND gates, and the like) to perform control functionality instead of relying upon software. Memory device 184 can include one or more non-transitory computer-readable storage mediums, such as RAM, ROM, EEPROM, EPROM, flash memory devices, magnetic disks, etc., and/or combinations thereof. Memory device 184 may be a separate component from processor 182 or may be included onboard within processor 182. Memory devices 184 can store data 186 and instructions 188 that are executed by processor 182 to cause controller 180 to perform operations. For example, instructions 188 can include instructions for voice/speech recognition and/or for determining a position of assistive control attachment 156 based at least in part on one more signals received by controller 180.

Circuit board 176 also includes a sensing device 190. Sensing device 190 senses or captures the position or orientation of assistive control attachment 156. Sensing device 190 can sense the position of assistive control attachment 156 at any suitable time, such as e.g., an accelerometer, when a user manipulates assistive control attachment 156, at predetermined time intervals, and/or upon a user status request. Sensing device 190 can be any suitable device capable of sensing the position or orientation of assistive control attachment 156, such as e.g., an accelerometer, a magnetometer, a gyroscope, a combination of the foregoing, or any other suitable device. For this embodiment, sensing device 190 is a three-axis accelerometer attached to or integral with circuit board 176. In some embodiments, however, sensing device 190 need not be attached to or integral with circuit board 176. Sensing device 190 can be housed within, embedded with, or otherwise connected to housing 174. Sensing device 190 can be directly connected to housing 174 or can be indirectly connected to housing 174 (e.g., by being attached to circuit board 176 which is in turn connected to housing 174).

Sensing device 190 is communicatively coupled with controller 180 such that when assistive control attachment 156 is manipulated by a user (i.e., by rotating assistive control attachment 156), sensing device 190 senses the position of assistive control attachment 156 and routes one or more signals indicative of the position of assistive control attachment 156 to controller 180. Upon receiving the one or more signals, controller 180 may then process the signals and determine the position of assistive control attachment 156. As noted above, sensing device 190 can also sense the position of assistive control attachment 156 and rout one or more signals to controller 180 at times other than when a user manipulates assistive control attachment 156, such as e.g., when a user makes a status request or at certain intervals when the appliance is turned to an "on" position. Additionally or alternatively, in some embodiments, sensing device 190 can also be configured to sense motion, touch, light, temperature, and any other suitable environmental inputs.

Referring still to FIG. 6, circuit board 176 also includes a communication interface 200. Communication interface 200 allows assistive control attachment 156 to communicate with a user and vice versa. As shown, communication interface 200 is attached to or integral with circuit board 176. However, in some embodiments, communication interface 200 need not be attached to or integral with circuit board 176. For this embodiment, communication interface 200 is an onboard component of circuit board 176 and is communicatively coupled with controller 180 via circuit board 176. Additionally or alternatively, communication interface 200 can be integral with controller 180. In this way, communication interface 200 can be an onboard component of controller 180 or it can be a separate, off board component as shown in FIG. 6. Communication interface 200 can be directly connected to housing 174 or can be indirectly connected to housing 174 (e.g., by being attached to circuit board 176 which is in turn connected to housing 174).

In some embodiments, a mode of operation of range appliance 100 can be determined and communicated to a user. When a user manipulates assistive control attachment 156 to one of the modes of operation of range appliance 100, the position or orientation of assistive control attachment 156 changes. When assistive control attachment 156 is manipulated, sensing device 190 senses the position or orientation of newly positioned assistive control attachment 156. Sensing device 190 sends and controller 180 receives the one or more signals indicative of the position of the assistive control attachment 156. Controller 180 then processes the signals to determine the position of assistive control attachment 156 based at least in part on the one or more signals. Then, controller 180 determines the mode of operation of range appliance 100 based at least in part on the position of assistive control attachment 156. The position of assistive control attachment 156 corresponds with a particular mode of operation of range appliance 100. After the mode of operation of range appliance 100 is determined, one or more signals are sent to communication interface 200 to communicate the mode of operation of range appliance 100 to a user.

It will be appreciated that assistive control attachment 156 must first be calibrated such that controller 180 can associate a particular position of assistive control attachment 156 with a mode of operation of range appliance 100. By way of example, a user can train assistive control attachment 156 by positioning assistive control attachment 156 at various setpoints (e.g., cooktop heat settings, washer settings, dryer settings, etc.) and then recording the position of assistive control attachment 156. The recorded positions can then be labeled by any suitable means. For instance, a user can use voice recordings to label each position or can label the positions by entering text into an application executable on a user device, for example. Once the positions are labeled, the positions can be stored in memory 184 of controller 180. Thereafter, assistive control attachment 156 is configured to assist users with operation of their appliances.

As further shown in FIG. 6, communication interface 200 can include any number or combinations of user interfaces that allow a user to communicate with assistive control attachment 156 and vice versa. In this way, assistive control attachment 156 can be customized to fit the needs of a particular individual and multiple channels of communication can be used for communication.

Figure 8:
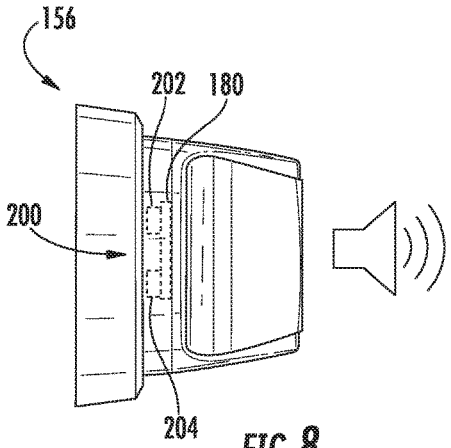
FIGS. 8 through 11 provide exemplary assistive control attachments configured with various communication interfaces according to exemplary embodiments of the present subject matter.

By way of example, FIG. 8 provides exemplary assistive control attachment 156 having a communication interface 200 that includes a speaker 202 and a microphone 204. As shown, speaker 202 and microphone 204 are communicatively coupled with controller 180. Speaker 202 can provide audible communications to a user whereas microphone 204 can detect audible communications from a user. Controller 180 can include software applications for processing audible communications (i.e., voice commands) from a user and selecting the correct audible message in response to the user's audible communications. In this way, assistive control attachment 156 can be configured with voice control functionality. For example, if a user makes a status request as to the mode of operation of range appliance 100 (e.g., "What is the heat setting of the front right burner?"), microphone 204 can detect the audible communication from the user and can rout the signal or signals indicative of the request to controller 180. Controller 180 can then process the signals, request a status inquiry from the sensing device 190 as to the position or orientation of assistive control attachment 156, and then upon receipt of the status, controller 180 can send one or more signals to speaker 202 to communicate the status of range appliance 100 to the user.

Moreover, in some embodiments, in addition to microphone 204 and speaker 202, communication interface 200 can include one or more components for relaying or routing the communications to certain user devices. For example, assistive control attachment 156 can include one or more transmitting, receiving, and/or transceiving components configured to relay communications to or from other devices. For example, such transceiving components can include a two-way radio transceiver (not shown). In this way, a user may check the status of the range appliance 100 from a remote location.

Figure 9:
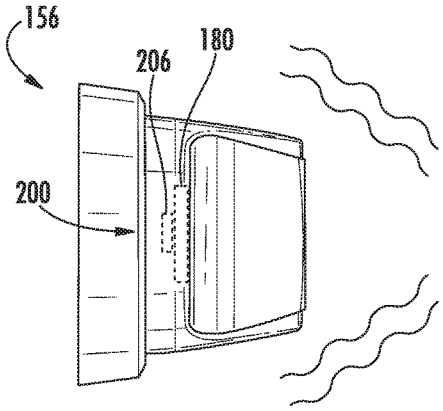

As another example, FIG. 9 provides exemplary assistive control attachment 156 having a communication interface 200 that includes a vibration device 206 communicatively coupled with controller 180. Vibration device 206 can provide haptic communications to a user. For instance, as a user manipulates assistive control attachment 156, vibration device 206 can vibrate, as shown by the vibration waves in FIG. 9, a predetermined number of pulses for a particular mode of operation of range appliance 100, such as e.g., one (1) vibration pulse for a "low" heat setting, two (2) vibration pulses for a "medium" heat setting, and three (3) vibration pulses for a "high" heat setting. In this way, a user can rely on his or her sense of touch to determine the mode of operation of range appliance 100. Vibration device 206 can be any suitable device capable of vibrating assistive control attachment 156. For this embodiment, vibration device 206 is an electric motor.

Figure 10:
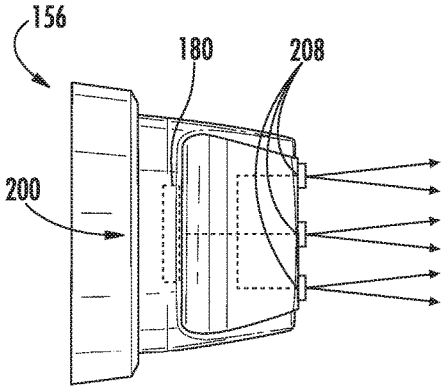

As yet another example, FIG. 10 provides exemplary assistive control attachment 156 having a communication interface 200 that includes one or more lighting devices 208 communicatively coupled with controller 180, such as e.g., one or more LEDs. For this embodiment, assistive control attachment 156 includes three (3) lighting devices 208 that may each emit light rays. Lighting devices 208 can communicate a mode of operation of range appliance 100. For instance, as a user manipulates assistive control attachment 156, one or more of lighting devices 208 can emit light depending on the mode of operation of range appliance 100, such as e.g., one (1) light can emit light for a "low" heat setting; two (2) lights can emit light for a "medium" heat setting; and three (3) lights can emit light for a "high" heat setting. In this way, a user can rely on his or her ability to sense light to determine the mode of operation of range appliance 100. In other exemplary embodiments, lighting devices 208 can be illuminated with various colors to communicate a mode of operation of the appliance to a user, with each lighting device color corresponding to a mode of operation of range appliance 100.

Figure 11:
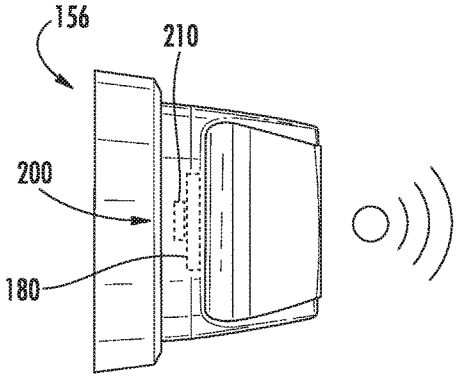

As another example, FIG. 11 provides exemplary assistive control attachment 156 having a communication interface 200 that includes a network interface 210. Network interface 210 can communicate a mode of operation of range appliance 100 over any suitable network to one or more network nodes, such as e.g., a user's electronic device or an intelligent home control system, such that the network node can then communicate the mode of operation of range appliance 100. Network interface 210 can include any suitable hardware for wireless and/or wired communications over a network, such as e.g., network interface cards, antennas, adapters, cables, etc. as well as other transmitting, receiving, and/or transceiving components. Network interface 210 can communicate via a wired or wireless signal to communicate with a user device or home control system, for example.

It will be appreciated that assistive control attachment 156 can include a communication interface 200 that can be configured to communicate by more than one channel of communication. Stated alternatively, communication interface 200 can include features for communication via voice control, haptic feedback, presentation of lighting devices, over a network via one or more user devices, or a combination of the foregoing.

Figure 12:
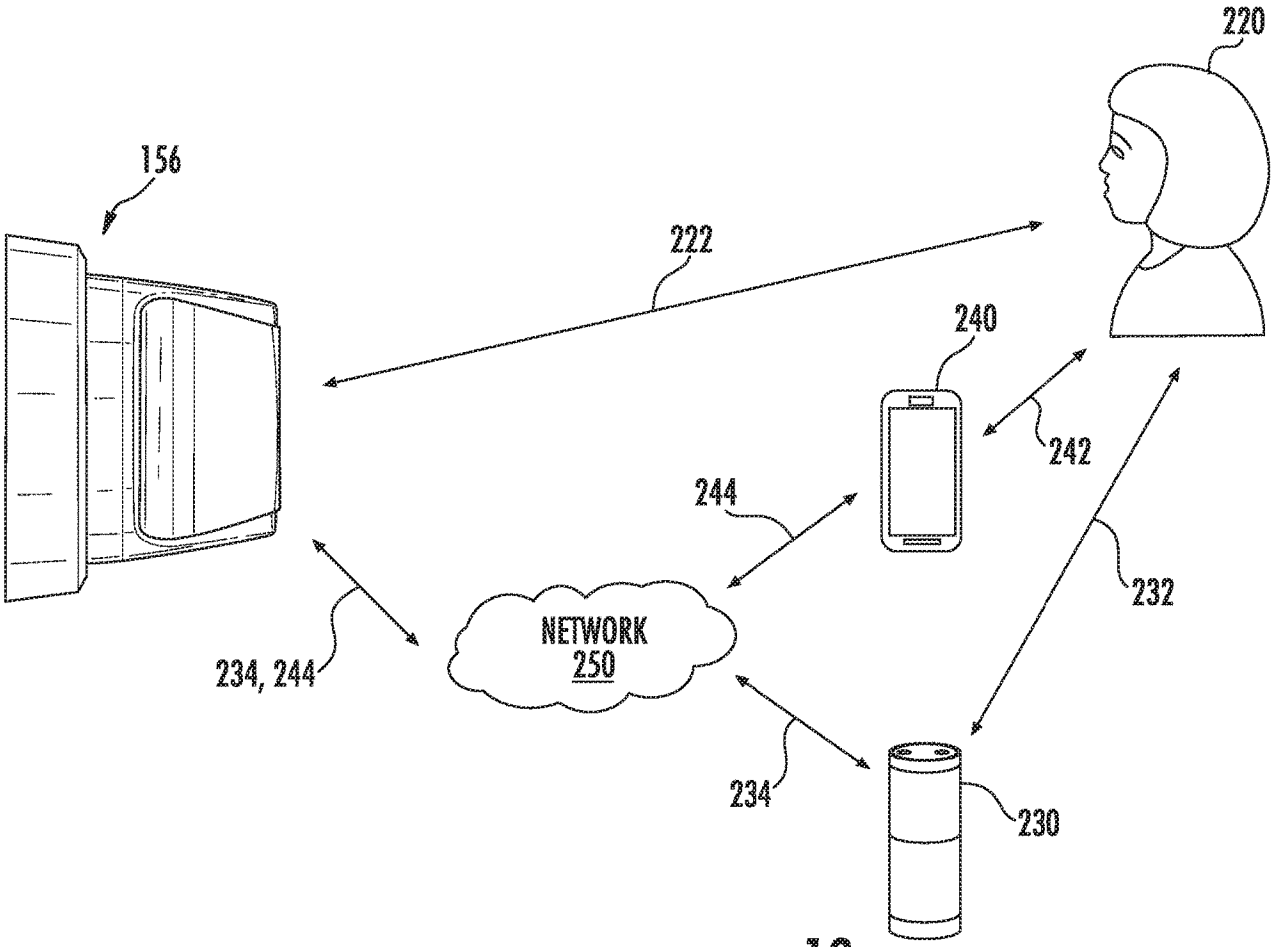
FIG. 12 provides a schematic view of an exemplary assistive control attachment of an exemplary appliance in operative communication with a user and communicatively coupled with various network nodes according to an exemplary embodiment of the present subject matter.

FIG. 12 provides a view of exemplary assistive control attachment 156 in operative communication with a user 220 and communicatively coupled with various network nodes, including a home control system 230 and a user device 240, according to an exemplary embodiment of the present subject matter. As noted above, assistive control attachment 156 can communicate with user 220 in a number of different ways. In particular, communication interface 200 of assistive control attachment 156 can provide for operative communication between assistive control attachment 156 and user 220 and/or communication over one or more networks.

As shown, user 220 is in operative communication with assistive control attachment 156, denoted by arrow 222. In some embodiments, as noted above, assistive control attachment 156 can be in operative communication via voice control or more generally audible outputs. In such embodiments, assistive control attachment 156 can include a communication interface 200 having microphone 204, speaker 202, and voice recognition software executable on processor 182 of controller 180, for example. In some embodiments, assistive control attachment 156 can be in operative communication via haptic feedback. In such embodiments, assistive control attachment 156 can include a communication interface 200 having a vibration device 206, such as a vibration motor, for example. Moreover, in some further embodiments, assistive control attachment 156 can be in operative communication via lighting devices 208 of communication interface 200. In such embodiments, lighting devices 208 emit or illuminate light depending on the selected mode of operation of range appliance 100.

As further shown in FIG. 12, in some embodiments, user 220 can communicate with assistive control attachment 156 via a home control system 230. More specifically, user 220 can be in operative communication with home control system 230, denoted by arrow 232, and home control system 230 can be communicatively coupled with assistive control attachment 156, denoted by arrow 234, over a network 250. In this way, user 220 can communicate with assistive control attachment 156 to determine the mode of operation of range appliance 100.

Home control system 230 can include one or more speakers and one or more microphones for receiving/sending audible inputs/outputs for communication. This allows users 220 to communicate with home control system 230 via voice control, for example. Home control system 230 can include one or more controllers with the same or similar components as described above with regard to controller 180 of assistive control attachment 156. For instance, controller of home control system 230 can include one or more processors and one or more memory devices that store instructions that are executable by the processor to cause home control system 230 to perform operations, such as e.g., processing a user status request as to a current mode of operation of range appliance 100 or sending one more signals to the speakers of home control system 230 such that a mode of operation of range appliance 100 can be communicated to user 220 via voice control. Home control system 230 can be an Amazon Echo manufactured by Amazon.com, Inc. configured with a digital personal assistant for receiving and carrying out voice control commands, for example. However, home control system 230 can be any suitable type of control system capable of communication with user 220 and assistive control attachment 156.

Network 250 can be any suitable type of network, such as a local area network (e.g., intranet), wide area network (e.g., internet), low power wireless networks, e.g., Bluetooth Low Energy (BLE), or some combination thereof and can include any number of wired or wireless links. In general, communication over network 250 can be carried via any type of wired and/or wireless connection, using a wide variety of communication protocols (e.g., TCP/IP, HTTP, SMTP, FTP), encodings or formats (e.g., HTML, XML), and/or protection schemes (e.g., VPN, secure HTTP, SSL).

As further shown in FIG. 12, user 220 can communicate with assistive control attachment 156 via a user device 240 over network 250. More specifically, user 220 can be in operative communication, denoted by arrow 242, with user device 240 and user device 240 can be communicatively coupled, denoted by arrow 244, with assistive control attachment 156 over a network 250. In this way, user 220 can communicate with assistive control attachment 156 to determine the mode of operation of range appliance 100.

User device 240 can be any suitable type of device, such as, for example, a personal computing device (e.g., laptop or desktop), a mobile computing device (e.g., smartphone or tablet), a gaming console or controller, a wearable computing device, an embedded computing device, a remote, or any other suitable type of user computing device. User device 240 can include one or more controllers with the same or similar components as described above with regard to controller 180 of assistive control attachment 156. For instance, controller of user device 240 can include one or more processors and one or more memory devices that store instructions that are executable by the processor to cause user device 240 to perform operations, such as e.g., processing a voice command from user 220 or initiating one or more vibration pulses to communicate a mode of operation of the appliance to user 220.

User device 240 can include one or more user inputs such as e.g., buttons, one or more cameras, and/or a display configured to display graphical user interfaces and/or other visual representations to user 220. For example, display can display graphical user interfaces corresponding to the modes of operation of range appliance 100. Display can be a touch sensitive component (e.g., a touch-sensitive display screen or a touch pad) that is sensitive to the touch of a user input object (e.g., a finger or a stylus). For instance, user 220 may touch the display to make a status request as to the current mode of operation of the appliance. In addition, motion of the user input object relative to the display can enable user 220 to provide input to user device 240. User device 240 may provide other suitable methods for providing input to user device 240 as well. Moreover, user device 240 can include one or more speakers, one or more cameras, and/or one or more microphones such that user device 240 is configured with voice control, motion detection, and other functionality.

User device 240 can be used to communicate with assistive control attachment 156 in any suitable manner. In some embodiments, for example, to communicate the mode of operation of range appliance 100, user device 240 can display the mode to user 220 via a graphical user interface on a display of user device 240, audibly communicate the mode to user 220 via one or more speaker devices of user device 240, vibrate a predetermined number of pulses via a vibration device (e.g., a vibration motor) of user device 240 to communicate the mode to user 220, or illuminate or emit a certain lighting sequence or color pattern on a display of user device 240 to communicate the mode. It will be appreciated that user device 240 can communicate the mode of operation of range appliance 100 in any suitable manner and that the methods noted above are for example purposes.

Figure 13:
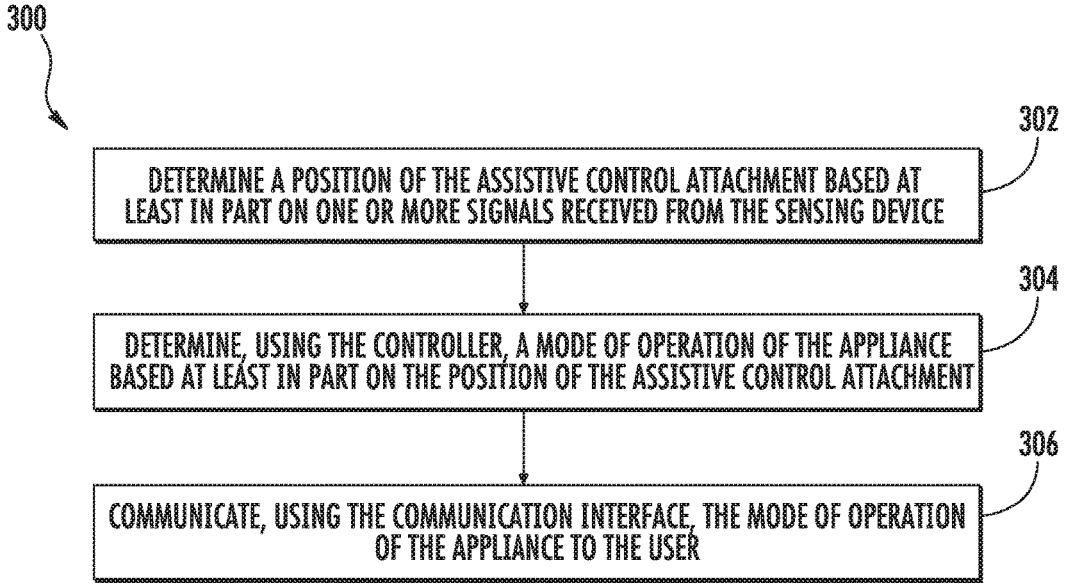
FIG. 13 provides a flowchart of a method for operating an assistive control attachment for an appliance according to an exemplary embodiment of the present subject matter.

FIG. 13 provides a flow diagram of a method (300) for communicating a mode of operation of an appliance to a user using assistive control attachment 156 according to exemplary embodiments of the present disclosure. Method (300) can be used to communicate a mode of operation to a user using assistive control attachment 156 for any suitable type of appliance. As an example, method (300) may be used to operate assistive control attachment 156 (FIG. 6) of range appliance 100 (FIG. 1). Assistive control attachment 156 can include controller 180, sensing device 190, and communication interface 200 to implement method (300). Utilizing method (300), users with certain impairments can operate their appliances with the confidence that they have selected the desired mode of operation, thereby improving the life quality, safety, and independence of such users.

At (302), exemplary method (300) includes determining a position of assistive control attachment 156 based at least in part on one or more signals received from sensing device 190. As an example, assistive control attachment 156 can include sensing device 190 configured to sense the position or orientation of assistive control attachment 156. Once sensing device 190 senses the position of assistive control attachment 156, one or more signals can be routed from sensing device 190 to controller 180. Controller 180 can then process the signals to determine a position of assistive control attachment 156.

At (304), exemplary method (300) includes determining, using controller 180, a mode of operation of the appliance based at least in part on the position of assistive control attachment 156. As an example, after the position of assistive control attachment 156 is known, controller 180 can correlate the known position to one of the modes of operation of the appliance. For instance, suppose a rotatable assistive control attachment 156 for range appliance 100 includes an "off", "high", and "low" mode of operation. Suppose that the "off" mode is positioned in a twelve o'clock position (with reference to the face of a clock), the "high" mode is positioned in a two o'clock position, and the "low" mode is positioned in a four o'clock position. When assistive control attachment 156 is calibrated, assistive control attachment 156 learns or links the various modes of operation with their corresponding positions or orientations. The calibrated positional/mode of operation relationships are then stored as data 186 in memory device 184 of controller 180. When a user manipulates assistive control attachment 156 and sensing device 190 routs one or more signals to controller 180, controller 180 can determine the position of assistive control attachment 156. For instance, controller 180 may use a lookup table or the like to correlate the position to one of the modes of operation of range appliance 100. For example, a twelve o'clock position can correlate with an "off" mode, a two o'clock position can correlate with a "high" mode, and a four o'clock position can correlate with a "low" mode. Thus, based at least in part on the position of assistive control attachment 156, the mode of operation of the appliance can be determined.

At (306), exemplary method (300) includes communicating, using the communication interface 200, the mode of operation of the appliance to the user. As noted above, assistive control attachment 156 can communicate with a user via communication interface 200 in any suitable manner. For example, assistive control attachment 156 can communicate via voice control directly with a user, via home control system, or via user device 240, among other possible devices. As another example, assistive control attachment 156 can communicate via haptic feedback by employing one or more vibration devices 206 within assistive control attachment 156. Moreover, assistive control attachment 156 can communicate with one or more user devices 220 that include haptic feedback functionality such as e.g., a cellphone. As yet another example, assistive control attachment 156 can communicate with one or more users via lighting devices 208 positioned on assistive control attachment 156 that can present one or more lighting sequences to a user depending on the mode of operation selected and/or the position of assistive control attachment 156. In addition, assistive control attachment 156 can communicate users via one or more lighting devices 208 positioned on a user device, such as e.g., a personal tablet. As yet another example, assistive control attachment 156 can communicate with a user via a network interface 210 by sending one or more signals over network 250 such that some presentation of the mode of operation of the user is presented via a graphic user interface on a user device 240. It will be appreciated that other methods of communication are also possible.

In some exemplary implementations, prior to determining the position of assistive control attachment 156, the method (300) further includes manipulating assistive control attachment 156. When manipulation of assistive control attachment 156 occurs, the user may be interested in confirming and/or knowing the mode of operation that the user did in fact select. In some implementations, upon user manipulation of assistive control attachment 156, the position of assistive control attachment 156 is automatically determined, and based at least in part on the position, the mode of operation of the appliance is automatically determined. Thereafter, the mode of operation of the appliance is automatically communicated to the user. In this manner, assistive control attachment 156 can be configured to automatically communicate the mode of operation of the appliance upon user manipulation of assistive control attachment 156.

In some exemplary implementations, prior to determining the position of assistive control attachment 156, the method (300) further includes receiving a status request as to a current mode of operation of the appliance from the user. In some instances, a user may want to confirm the mode of operation of the appliance. In such a circumstance, the user can make a status request to assistive control attachment 156, and in response, assistive control attachment 156 can communicate the current mode of operation to the user. For example, if user operating a washing machine appliance cannot remember whether a "bulky" or "delicates" setting was selected, the user can request a current status of the mode of operation of the washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An assistive control attachment for an appliance for communicating a mode of operation of the appliance to a user, the assistive control attachment comprising:

a control attachment housing configured to be attached to an existing control of the appliance, wherein the existing control is mounted to a control panel of the appliance, and wherein a bezel is disposed between the existing control and the control panel, and wherein the control attachment housing has a bezel portion that is sized to overlay the bezel disposed between the existing control and the control panel so that the bezel portion of the control attachment housing is seated against or positioned substantially adjacent to a planar surface of the control panel;

a sensing device connected to the control attachment housing;

a communication interface connected to the control attachment housing, the communication interface configured to communicate the mode of operation of the appliance to the user; and a controller connected to the control attachment housing and communicatively coupled with the sensing device and the communication interface, the controller configured to:

receive one or more signals from the sensing device indicative of a position of the assistive control attachment;

determine the position of the assistive control attachment based at least in part on the one or more signals;

determine the mode of operation of the appliance based at least in part on the position of the assistive control attachment; and send one or more signals to the communication interface to communicate the mode of operation of the appliance to the user.

2. The assistive control attachment of claim 1, wherein to determine the mode of operation of the appliance based at least in part on the position of the assistive control attachment, the controller is configured to:

correlate the position of the assistive control attachment with one of the modes of operation of the appliance.

3. The assistive control attachment of claim 1, wherein the communication interface comprises a network interface for communicating the mode of operation of the appliance to the user over a network.

4. The assistive control attachment of claim 1, wherein when the user manipulates the assistive control attachment to one of the modes of operation of the appliance, the sensing device sends the one or more signals to the controller.

5. The assistive control attachment of claim 1, wherein when the user makes a status request as to a current mode of operation of the appliance, the sensing device sends the one or more signals to the controller.

6. The assistive control attachment of claim 1, wherein the communication interface comprises a vibration device for vibrating the control attachment housing to communicate the mode of operation of the appliance to the user.

7. The assistive control attachment of claim 1, wherein the communication interface comprises a speaker and a microphone for audibly communicating the mode of operation of the appliance to the user via voice control.

8. The assistive control attachment of claim 1, wherein the communication interface comprises one or more lighting devices for communicating the mode of operation of the appliance to the user.

9. The assistive control attachment of claim 1, wherein the communication interface comprises a network interface, and wherein the network interface is communicatively coupled with a home control system, and wherein the assistive control attachment is operable to communicate the mode of operation of the appliance to the user via the home control system.

10. The assistive control attachment of claim 1, wherein the assistive control attachment is configured to be attached to the existing control of the appliance, and wherein the existing control is an existing control knob and the control attachment housing is shaped as a control knob and complementary to the existing control knob such that the control attachment housing is configured to overlay the existing control knob.

11. The assistive control attachment of claim 1, wherein the assistive control attachment is a control knob and is shaped substantially identical to the existing control of the appliance.

12. The assistive control attachment of claim 1, wherein the control attachment housing comprises one or more walls, and wherein the controller and the sensing device are embedded within one of the one or more walls of the control attachment housing.

13. The assistive control attachment of claim 1, wherein the appliance is at least one of a washing machine appliance and a dryer appliance.

14. A method for communicating a mode of operation of an appliance to a user using an assistive control attachment, the method comprising:

mounting a control attachment housing of the assistive control attachment to an existing control of the appliance, wherein the existing control is mounted to a control panel of the appliance, and wherein a bezel is disposed between the existing control and the control panel, and wherein the control attachment housing has a bezel portion that is sized to overlay the bezel disposed between the existing control and the control panel so that the bezel portion of the control attachment housing is seated against or positioned substantially adjacent to a planar surface of the control panel;

determining, by a controller connected to the control attachment housing of the assistive control attachment, a position of the assistive control attachment based at least in part on one or more signals received from a sensing device connected to the control attachment housing;

determining, using the controller, the mode of operation of the appliance based at least in part on the position of the assistive control attachment; and communicating, using a communication interface of the assistive control attachment, the mode of operation of the appliance to the user.

15. The method of claim 14, wherein during determining the mode of operation of the appliance based at least in part on the position of the assistive control attachment, the method further comprises:

correlating the determined position of the assistive control attachment to one of the modes of operation of the appliance.

16. The method of claim 14, wherein prior to determining the position of the assistive control attachment, the method further comprises:

manipulating, by the user physically, the assistive control attachment to the mode of operation of the appliance.

17. The method of claim 14, wherein prior to determining the position of the assistive control attachment, the method further comprises:

receiving a status request as to a current mode of operation of the appliance from the user.

18. The method of claim 14, wherein the assistive control attachment communicates the mode of operation to the user via audible output.

19. The method of claim 14, wherein the existing control is an existing control knob and the assistive control attachment is a control knob shaped complementary to the existing control knob and overlays the existing control knob.

* * * * *